US007124510B2

(12) United States Patent
Frazer

(10) Patent No.: US 7,124,510 B2
(45) Date of Patent: Oct. 24, 2006

(54) KNIFE WITH DOUBLE-ENDED ROTATABLE BLADE

(75) Inventor: Spencer Frazer, Lynnwood, WA (US)

(73) Assignee: SOG Specialty Knives, Inc., Lynnwood, WA (US)

( * ) Notice: Subject to any disclaimer, the term of this patent is extended or adjusted under 35 U.S.C. 154(b) by 0 days.

(21) Appl. No.: 11/048,118

(22) Filed: Jan. 31, 2005

(65) Prior Publication Data

US 2006/0016080 A1 Jan. 26, 2006

Related U.S. Application Data

(60) Provisional application No. 60/540,463, filed on Jan. 29, 2004.

(51) Int. Cl.
*B26B 1/04* (2006.01)

(52) U.S. Cl. ..... 30/161; 30/155

(58) Field of Classification Search ..... 30/152, 30/153, 156, 155, 161, 299, 321, 164; 7/105, 7/158, 168

See application file for complete search history.

(56) References Cited

U.S. PATENT DOCUMENTS 98,949 A * 1/1870 Gerelds ..... 30/161
234,378 A * 11/1880 Pierce ..... 7/168
234,731 A 11/1880 Slayton
978,165 A * 12/1910 Johnson ..... 30/161
1,552,361 A * 9/1925 Trombley ..... 7/105
2,343,175 A 2/1944 Evinger
2,820,291 A * 1/1958 Philippar ..... 30/153
4,442,559 A 4/1984 Collins
4,606,123 A 8/1986 Wrench
4,608,757 A * 9/1986 Eckerle ..... 30/299
4,651,419 A 3/1987 Reed, Jr.
5,093,995 A 3/1992 Jan
5,404,646 A * 4/1995 Naifeh ..... 30/163
5,966,816 A 10/1999 Roberson

* cited by examiner

*Primary Examiner*—Hwei-Siu Payer
(74) *Attorney, Agent, or Firm*—Christensen O'Connor Johnson Kindness PLLC

(57) ABSTRACT

A long blade of a knife has first and second working end portions disposed at opposite sides of the blade central portion. The central portion of the blade is pivotally attached to a handle such that, in a first position, the first working end portion is exposed for use and the second working end portion extends along the handle, and in a second position, the second end portion of the blade is exposed for use and the first end portion of the blade extends along the handle. A spring biased locking mechanism is provided to retain the blade in either of the first or second positions.

1 Claim, 2 Drawing Sheets

KNIFE WITH DOUBLE-ENDED ROTATABLE BLADE

CROSS-REFERENCE TO RELATED APPLICATION

This application claims the benefit of U.S. Provisional Application No. 60/540,463, filed on Jan. 29, 2004.

FIELD OF THE INVENTION

The present invention relates to a tool, particularly a knife having different cutting ("working") portions at opposite ends, rotatably mounted in a handle.

BACKGROUND OF THE INVENTION

In a typical folding knife construction, a blade is pivoted to a handle for movement between an open position in which the working end portion of the blade is exposed for use and a closed position in which the working end portion of the blade is received in the handle. In a variation, there have been attempts to provide knives having blades with more than one working end portion, including knives in which the blades are rotatably mounted in a handle and working end portions are provided at opposite ends of the blade.

SUMMARY OF THE INVENTION

The present invention provides a knife having different cutting or "working" portions at opposite ends, rotatably mounted in a handle, with a convenient blade lock to retain a desired working end portion of the blade exposed for use. The blade lock can include a lever mounted in a handle. The lever can carry a locking pin to engage in a selected hole through the blade. The locking lever can be spring biased to a position in which the pin is received in the hole, and the pin can be pivotally mounted on a swinging end of the lever.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 2:
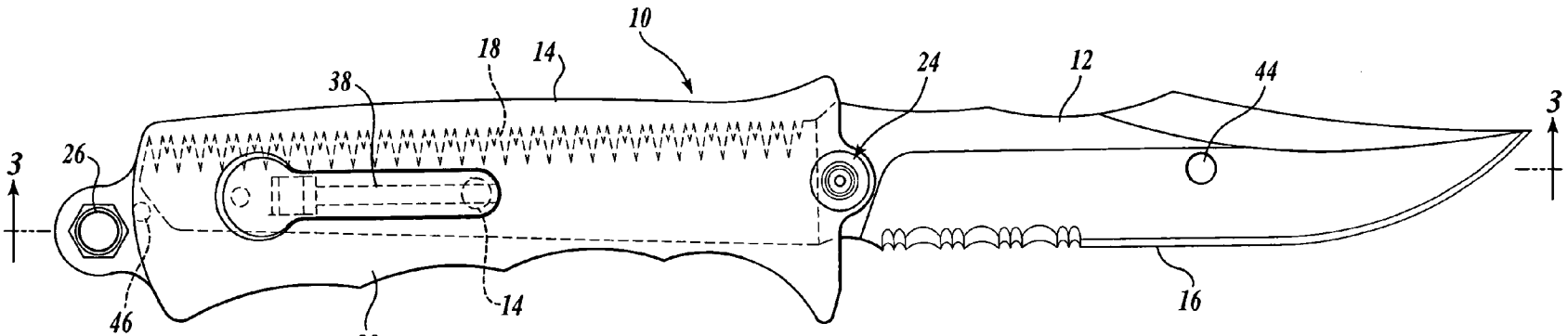
FIG. 2 is a side elevation thereof.

Referring to the drawings, the knife 10 in accordance with the present invention has a long blade 12 rotatably attached to a handle 14. The blade can be approximately twice as long as the handle. In the locked position shown in FIGS. 2 and 3, the blade has a first working end portion projecting from the handle with a sharpened edge 16 exposed for use and a second working end portion nested within the handle with a sharpened edge 18 concealed. Edges 16 and 18 are located on opposite sides of the blade. For example, when edge 16 is exposed at the bottom, as shown in FIG. 2, edge 18 is along the top. The blade is pivotally attached to the handle in the central portion of the blade such that, with the locking mechanism described below released, the blade can be rotated 180° from the position shown in FIG. 2 to a position in which the first end portion is nested in the handle and the second end portion projects therefrom with its sharpened edge 18 exposed.

The handle 14 has two side pieces 20, 22 joined together by threaded fasteners 24 and 26 at the front end and at the back end. The back or rear end portions of the side pieces abut. At the front, the threaded fastener 24 is configured to maintain the desired spacing between the two side pieces, slightly greater than the width of the central portion of the blade, with room for an antifriction washer 28 at each side. Each side piece has a thin, flat liner 30 or 32, preferably metal, secured to the remainder of the handle side pieces which can be molded plastic. Side piece 20 has a recess 34 for the locking mechanism 36.

Figure 3:
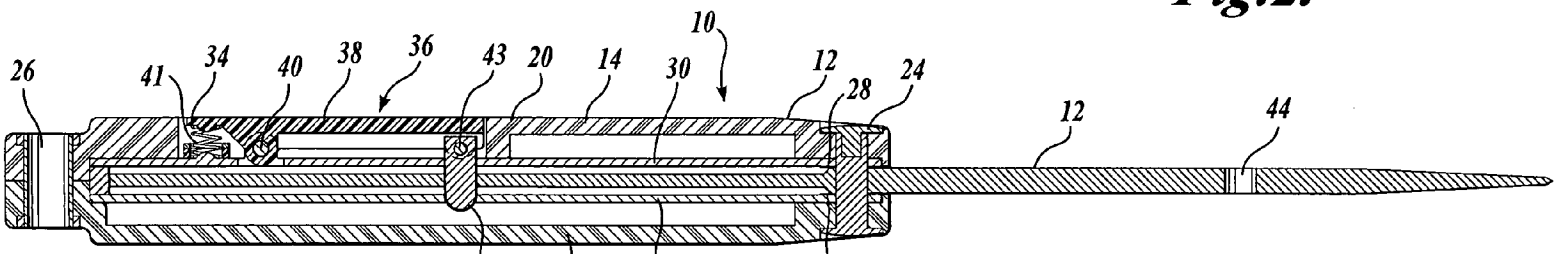
FIG. 3 is a horizontal, longitudinal section along line 3—3 of FIG. 2.

The locking mechanism includes a lever 38 which, in the normal locked position shown in FIGS. 2 and 3, has an outer surface flush with the outer surface of the handle side piece 20. As see in FIGS. 2 and 3 the full extent of the lever 38 is disposed between the blade pivot and the back end of the handle. The corresponding liner 30 has inturned tabs to support a short axle 40 by which the lever is pivotally mounted to its side piece. A helical compression spring 41 has its opposite ends engaged between the rear end portion of the lever and the liner, biasing the lever to the position in FIGS. 2 and 3 in which its leading end portion engages against the inner surface of the liner.

Figure 1:
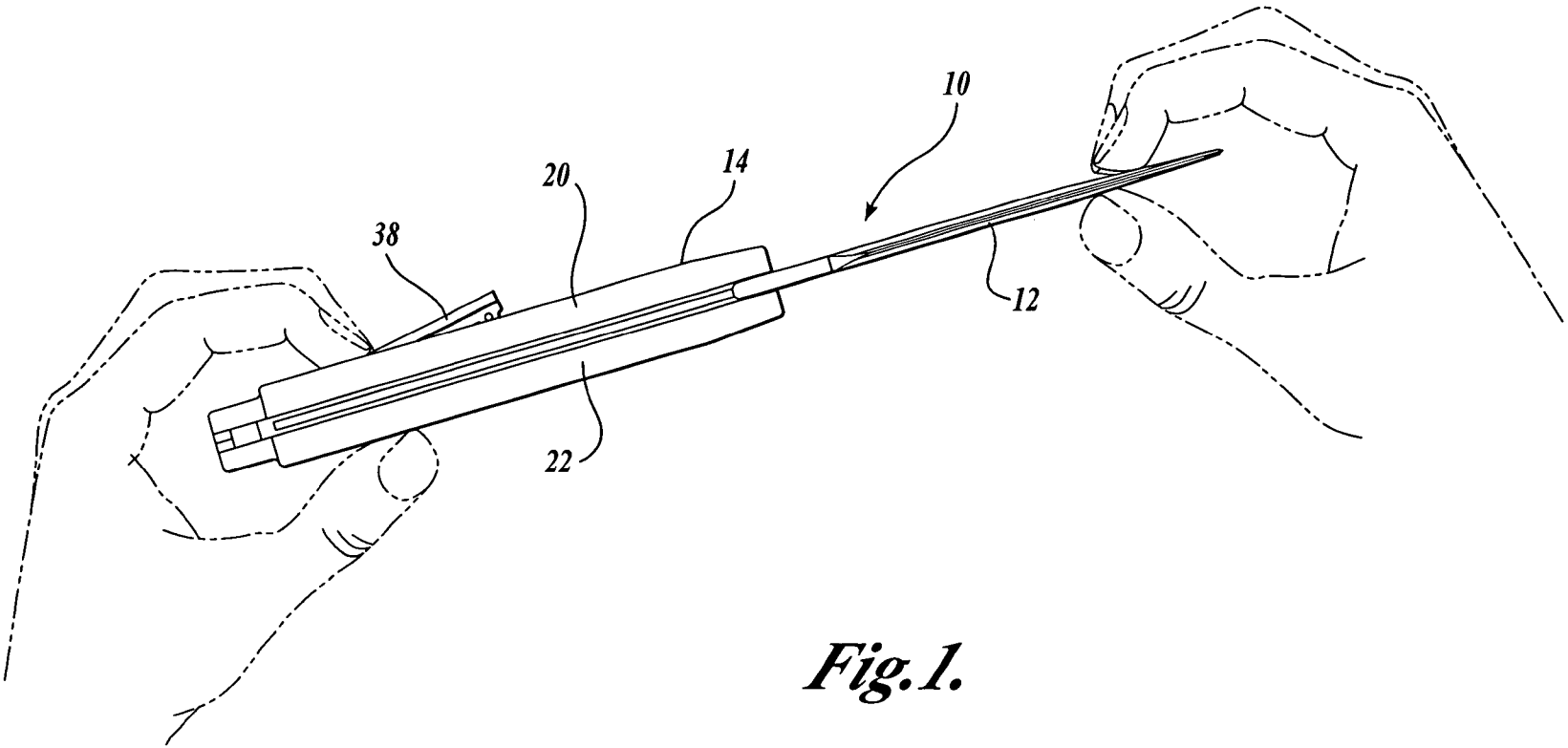
FIG. 1 is a top plan of the new knife with double-ended rotatable blade in accordance with the present invention.
Figure 3A:
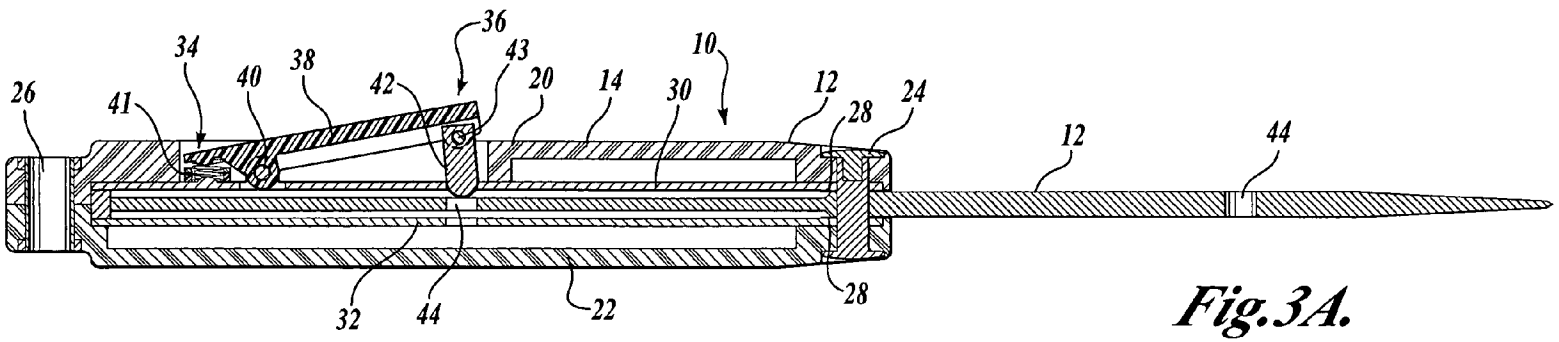
FIG. 3A is a corresponding section with parts in different positions.

A lock pin 42 is pivotally carried by the front end portion of the lever (by another small axle 43) and protrudes through aligned holes in the liner 30, blade 12, and liner 32. In this position, the blade is reliably and stably positioned with one or the other of its end portions projecting from the handle. The locking mechanism can be released by pressing inward on the rear end portion of the lever, against the biasing force of the helical compression spring. This swings the lever to the position shown in FIGS. 1 and 4 in which the locking pin 42 is retracted sufficiently that it does not extend through a locking hole 44 of the blade. The blade can then be swung 180° to change the working end portion that projects from the handle, whereupon the lever 38 is released to lock the blade in the new position. As see in FIGS. 3 and 3A, the free end of the pin 42 is tapered or rounded which assists in guiding the thicker shank of the pin snugly into the lock hole 44.

Preferably, the handle includes a stop pin 46 (FIG. 2) at its rear end in the path of the blade, so that when an end portion of the blade engages the stop pin, the locking pin 42 is registered with the hole 44 in the corresponding end portion of the blade. For example, in FIG. 2 the stop pin 46 is positioned to prevent counterclockwise rotation of the blade because the second end portion of the blade is engaged against the top part of the stop. However, when the locking mechanism is released (FIG. 4) the blade can be rotated clockwise until the first end portion of the blade engages against the underside of the stop 46, at which point the locking hole 44 in the first end portion of the blade will be aligned with the lock pin 42, and the lever 38 can be released to lock the blade in position. Thus, the user can quickly and easily select between the first and second working end portions of the blade to be exposed for use, and safely lock the blade in the desired position.

While the preferred embodiment of the invention has been illustrated and described, it will be appreciated that various changes can be made therein without departing from the spirit and scope of the invention.

The invention claimed is:

1. A tool comprising:

an elongated blade having first and second working end portions and a central portion therebetween, the blade having sharpened edge portions disposed along opposite edges of the blade at the first and second end portions thereof, respectively;

an elongated handle having a front end and a back end, the handle including two plastic side pieces and two metal liners defining a blade receiving space therebetween, the central portion of the blade being pivotally attached adjacent to the front end of the handle for swinging between a first position in which the first end portion of the blade is exposed for use and the second end portion of the blade is received in the blade receiving space between the handle liners and a second position in which the second working end portion of the blade is exposed for use and the first end portion of the blade is received in the blade receiving space;

means for selectively locking the blade in the first and second positions, the locking means including a lever pivotally attached to the handle, the full extent of the lever being disposed between the back end of the handle and the pivotal attachment of the blade adjacent to the front end of the handle, a locking pin pivotally mounted to and extending transversely from the lever and, by movement of the lever, movable between a locked position extending through and interengaged with both liners and the blade in either of its first and second positions to block movement of the blade relative to the handle and a released position retracted from the blade so as to permit rotation thereof, the blade having locking holes positioned to register with the locking pin when the blade is in either of its first or second positions and the locking pin having a tapered end portion for receipt in and through the blade as the pin is moved toward the locked position, the handle having a stop positioned to prevent rotation of the blade in a selected direction when the blade is in either of the first or second positions, one of the two plastic side plates having a cavity, and the lever being mounted in the cavity; and a spring received in the cavity for biasing the lever to the locked position.

* * * * *